US005173245A

United States Patent [19]

Hall et al.

[11] Patent Number: 5,173,245

[45] Date of Patent: Dec. 22, 1992

[54] TUYERE INJECTOR

[75] Inventors: David E. Hall; Robert C. Francki, both of Sudbury, Canada

[73] Assignee: Inco Limited, Toronto, Canada

[21] Appl. No.: 810,193

[22] Filed: Dec. 19, 1991

[30] Foreign Application Priority Data

Feb. 1, 1991 [CA] Canada ..... 2035542

[51] Int. Cl.[5] ..... C21C 5/48

[52] U.S. Cl. ..... 266/47; 266/182; 266/221; 266/267

[58] Field of Search ..... 266/47, 176, 186, 221, 266/267, 182; 75/639, 643

[56] References Cited

U.S. PATENT DOCUMENTS 3,892,559 7/1975 Quarm ..... 266/221

FOREIGN PATENT DOCUMENTS 2263937 11/1987 Japan ..... 266/227

1423619 9/1988 U.S.S.R. ..... 266/227

*Primary Examiner*—Melvyn J. Andrews

*Attorney, Agent, or Firm*—Edward A. Steen; Blake T. Biederman

[57] ABSTRACT

An injector for introducing particulate material into the bath of a pyrometallurgical vessel via existing tuyeres. An existing mechanical puncher may be removed and replaced with an injector adapted to be attached to the existing tuyere body so as not to disturb the existing blast air connections. The injector, including a housing spatially circumscribing an injector pipe and forming an annular space part way therewith, is inserted into the tuyere. A source of pressurized fluid is injected into the annular space keeping the tuyere open so the particulate material can be introduced through the pipe.

7 Claims, 2 Drawing Sheets

TUYERE INJECTOR

TECHNICAL FIELD

The instant invention relates to converter operations in general and, more particularly, to an apparatus for injecting particulate material into the bath of a converter.

BACKGROUND ART

Nickel-copper Bessemer matte is typically produced by converting molten matte from a primary smelting furnace in Peirce Smith converters which employ blowing of air or air/oxygen mixtures into the bath via tuyeres. The Peirce Smith converter is the most common type of converter used for this application and consists of a horizontally oriented cylinder which has a hooded opening at the top and is rotatable through an arc of about 180 degrees. The plurality of tuyeres are located below the normal working level of the molten matte when in the blowing position. As a result of converter rotation, the tuyeres are above the bath for pouring and holding.

The objective of the conversion process is to oxidize the FeS in the matte to form iron oxides, liberating sulfur dioxide and leaving matte comprising nickel and copper sulfides with small but variable amounts of cobalt, precious metals and dissolved oxygen. This is accomplished by blowing an oxygen containing gas (air or oxygen enriched air) into the matte through the tuyeres. The oxygen combines with the iron and sulfur to form iron oxide and sulfur dioxide. The sulfur dioxide passes off as a gas and is subsequently treated to prevent fugitive emissions. The iron oxide unites with added silica flux to form an iron silicate slag that floats on top of the matte now richer in nickel and copper and much lower in iron. The oxidation process is exothermic and the heat generated is usually sufficient to cause the operation to be self-sustaining. Additions of fuel are typically not required.

After removal of substantially all of the iron by blowing and skimming of the slag, the resulting matte is cooled, cast and further treated for recovery of the valuable base and precious metals. Upon cooling, the copper and nickel in the matte form copper sulfide ($Cu_2S$), nickel sulfide ($Ni_3S_2$), and a metallic fraction containing small amounts of dissolved sulfur.

Turning to the tuyeres, compressed (or blast) air is delivered through a header disposed along the back of the converter. The header, generally delivering the blast air at about 15 pounds per square inch (103 kPa), feeds each tuyere. A plurality of horizontal tuyeres provide direct air passages through the converter lining into the interior of the converter.

After the converter is filled to the appropriate working level with the desired material, the tuyeres are above the level of the charge. The blast air supply is turned on and the converter is rotated to submerge the tuyeres a predetermined distance below the surface of the charge. As the tuyere air bubbles up through the charge, the desired oxidation processes occur.

Over time solid accretions begin to accumulate within each tuyere ultimately causing it to plug up. In order to keep the tuyeres open, a reciprocating rod is inserted into the tuyere. The rod is connected to a pneumatic valve that causes the rod to traverse the tuyere and literally punch out the accumulated mass back into the converter. An automatic pneumatic tuyere punch including the rod and the valve body is mounted to the exterior of the converter over the tuyere. At regular intervals the valve is energized to first ram the rod into the tuyere and then retract it. By repeating this process, the tuyere remains open to allow blast air to enter the converter.

With the increasing need to clean up industrial processes, reduce waste and pollution, and increase efficiency and recovery rates, it has been proposed to recycle certain materials back into the converter when possible for additional processing. Copper and nickel concentrates, electrostatic precipitator dust, catalytic converter dust and other materials may be fed into the converter for good effect.

Unfortunately, everything added to the charge must be currently done on a batch basis. Materials cannot be introduced into the converter in a steady, continuous stream. Moreover, by dumping material into the active converter, the material acts as a chill adversely affecting the temperature of the bath. Also, due to the blast effect, it is difficult to evenly introduce light weight materials, such as dust, into the converter without having them being blown out.

An example of an attempt to introduce fuel into a converter is disclosed in U.S. Pat. No. 4,711,433.- A blowing pipe assembly is designed to be removed before the charge is introduced into the converter. After the converter is rotated into the upright/blowing position, the blowing pipe assembly is then physically remounted to the tuyere. Besides requiring a constant repeated mounting and dismounting operation, there is no apparent acknowledgement of the problems concerning a plugged tuyere.

Another example of an attempt to introduce gas into an argon-oxygen-decarburization (AOD) vessel is shown by U.S. Pat. No. 4,795,138. A tuyere having inner and outer concentric tubes permits oxygen to flow within the central tube and an inert gas to flow within the outer tube so as to control the flow ratio of the gases entering the vessel.

Accordingly, there is a need for a technique that permits the expeditious, continuous introduction of particulate material into a converter and, more particularly, directly into the bath.

SUMMARY OF THE INVENTION

This invention relates to a tuyere injector that may be retrofitted onto an existing tuyere. The injector introduces particulate material directly into a converter.

PREFERRED EMBODIMENT OF THE INVENTION

Figure 1:
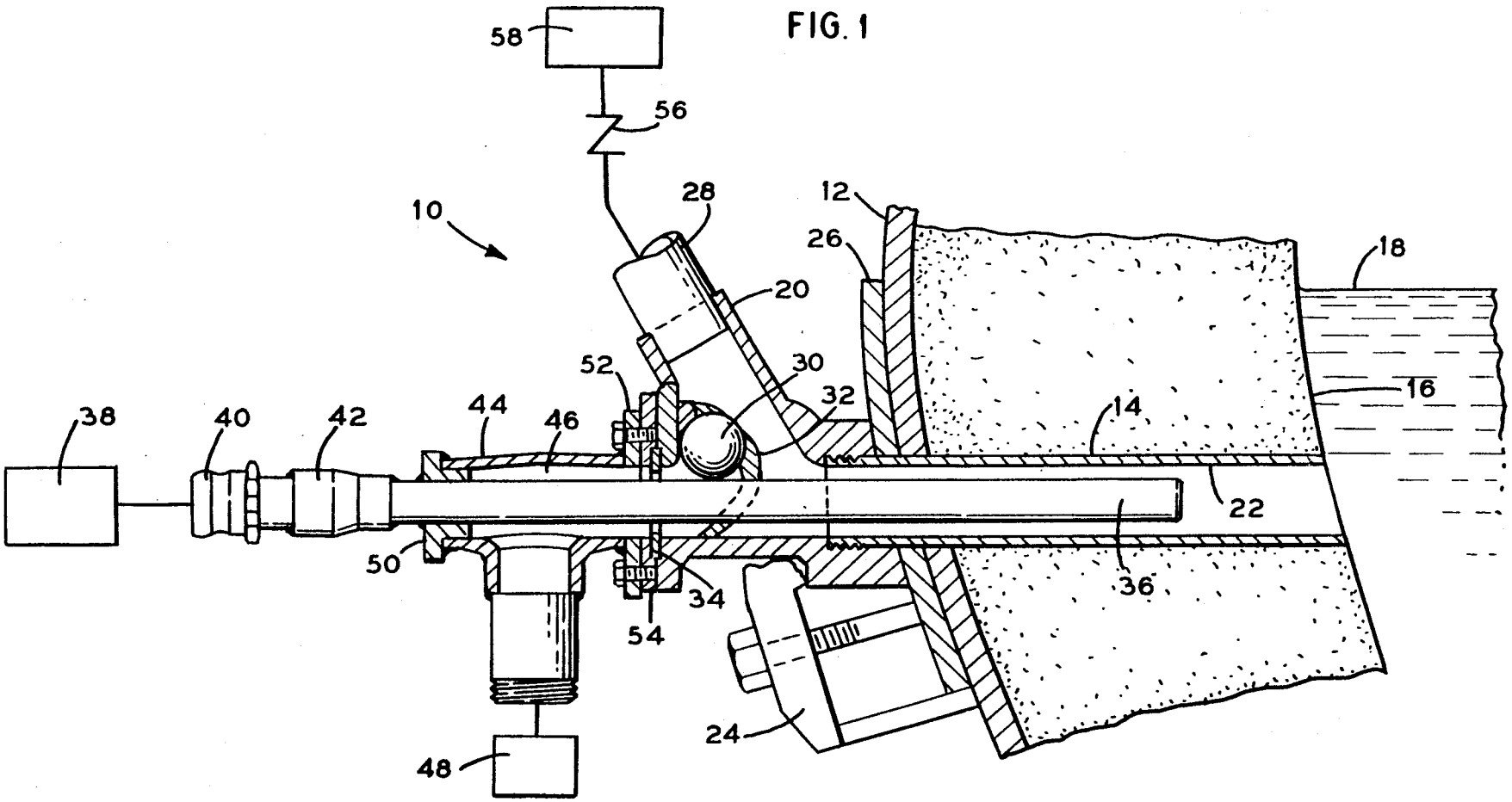
FIG. 1 is an elevation, in partial cross-section, of an embodiment of the invention.

Referring to FIG. 1, there is shown a tuyere injector 10 in partial cross section.

The injector 10 is attached to the wall of a converter 12 and is partially inserted into a tuyere 14. The tuyere 14 extends through a refractory layer 16 where it contacts the charge 18 typically comprised of matte and slag. For the purposes of discussion, only one tuyere 14 is shown. It should be appreciated, however, that a converter includes a plurality of tuyeres 14.

The injector 10 makes use of the existing tuyere 14 mounting hardware. Indeed, the pneumatic tuyere punch (not shown) is removed and essentially replaced by the injector 10.

The external portion of the tuyere 14 includes a tuyere body 20 which is threadably connected to a tuyere pipe 22 typically about 2 inches (51 mm) in diameter. A clamp 24, partially cut away, affixes the tuyere body 20 to a converter attachment plate 26.

The tuyere 14 is normally connected to a blast air downcomer 28. A one-way check valve 56 prevents high pressure air from back flowing into the air blast source 58. A tuyere ball 30 suspended between two parallel tracks 32 (only one is shown) acts as a one-way gate. A ring 34 prevents the ball 30 from escaping from the body 20.

When the injector 10 (or the pneumatic punch) is inserted into the tuyere body 20, the ball 30 is pushed upwardly (as is shown). When the injector 10 (or pneumatic punch) is removed, the ball 30 falls downwardly against the ring 34 to prevent the loss of the air blast coming from the downcomer 28. During normal operation, the ball 30 is essentially out of the way.

The injector 10 includes pipe 36 of somewhat smaller diameter than the tuyere pipe 22, preferably about 1 inch (25 mm) in diameter. The pipe 36 includes a plurality of spacers (not shown) to center the pipe 36 within the tuyere 14.

The injector pipe 36 communicates with a particulate/conveying air source 38. A quick connect coupling 40 and a pipe reducer 42 directly connect the injector 10 to the particulate/conveying air source 38. An oversized welding tee housing 44 circumscribes the pipe 36 to form an annular space 46 therebetween. The annular space 46 which may be of varying cross-sectional area continuously extends from the housing 44 through the body 20 and into the tuyere 14.

The tee 44 is also connected to a source of high pressure fluid 48 via a quick connect coupling (not shown) similar to the coupling 40. Air is the preferred fluid, but it is within the realm of possibility that some other agent may be used.

One end of the tee connector 44 includes an adaptor 50 to securely hold and space the pipe 36 within the connector 44. The opposing end of the tee connector 44 includes an injector face plate 52 that is bolted to a corresponding tuyere body face plate 54.

As can be readily appreciated, the tuyere injector 10 is designed to be easily retrofitted into an existing tuyere 14 for essentially a permanent installation; although it may be easily removed if necessary. The pneumatic tuyere puncher is removed by detaching it from the tuyere body face plate 54. As it is removed the ball 30 will fall sealing the opening. The tuyere injector 10 is then inserted into the tuyere body 20, pushing the ball 30 up and out of the way. The injector face plate 52 is bolted to the tuyere body face plate 54. After the injector 10 is secure, the particulate/conveying air source 38 and the high pressure air source 48 are connected. Note the blast air downcomer 28 and the clamp 24 do not need to be disturbed.

During converter operations, the blast air downcomer 28 generally supplies air or oxygen enriched air at about 15 pounds per square inch (103 kPa) to the tuyere 14. The particulate/conveying air source 38, depending on the entrained material and conveying means, will be delivered from about 15–20 pounds per square inch (103–138 kPa) to about 80–90 pounds per square inch (551–620 kPa).

High pressure air, on the order of 25–30 pounds per square inch (172–207 kPa) is introduced into the bottom of the tee housing 44 and is directed along the annular space 46. The air flow rate is normally 600–700 cubic feet per minute (17–20 $m^3$/min). The purpose of the annulus 46 air flow is to prevent solids buildup in the tuyere 14 since the tuyere 14 cannot be kept open mechanically while injecting and the converter 12 is in the blowing mode.

The conveying air and solid material from the source 38 are preferably introduced straight into the end of the injector 10 and along the pipe 36, eventually combining with the annulus 46 airflow as they all enter the molten bath 18. The conveying air flow and pressure are determined by the type of material being injected and the upstream air/material mixing device being used. The injected material may be flue dust, dry concentrate, or dry reverted material in the size range of −10 mesh.

The source 38 may be a blow tank. The material to be conveyed is introduced into the reinforced tank. The tank is pressurized to about 80–90 pounds per square inch (551–620 kPa) which then conveys the material through the coupling 40.

Figure 2:
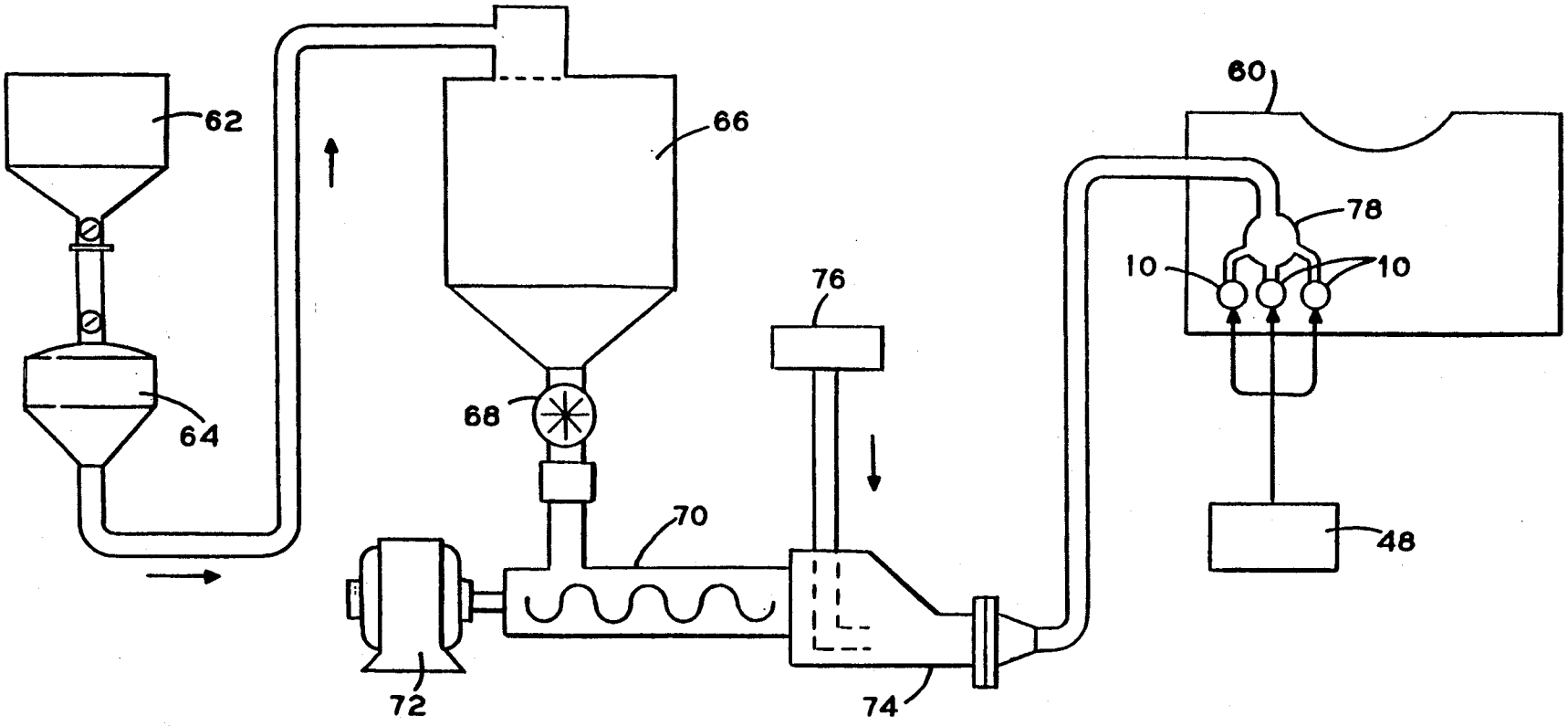
FIG. 2 is schematic of a non-limiting processing scheme utilizing an embodiment of the invention.

FIG. 2 depicts an alternative process schematic employing the tuyere injector 10.

The solid particulate material to be introduced into the converter 60 is first stored in a container 62 and then fed via a (Boothe TM) pneumatic conveying system 64 to a surge hopper 66. A variable speed rotary feeder 68 meters the correct amount of material to a (Fuller-Kinyon TM) high speed dust pump 70 driven by motor 72. From experience it was found that, when using a 4 inch screw pump, a motor 72 of at least 50 horsepower (37kw) is necessary to overcome some of the backpressure problems. The dust pump 70, including an internal screw with flights of decreasing pitch, forces the particulate material into a windbox 74. A supply 76 of conveying air communicates with the wind box 74 to propel the particulates toward the converter 60. The wind box 74 in this instance generically functions as the particulate/conveying air source 38 of FIG. 1.

The material may be routed to a header 78 and then split numerous ways (three are shown) before entering the corresponding number of tuyere injectors 10. The high pressure air source 48 communicates with the tuyere injectors 10 as discussed above.

The tuyere injector 10 is designed for expeditious retrofitting capability into an existing tuyere 14 provided a check valve 56 has been installed in downcomer 28. Once a particular tuyere 14 is selected it is a simple matter to remove the pneumatic punch and replace it with the tuyere injector 10. As an additional benefit, the existing blast air downcomer 28 system need not be disturbed at all. The tuyere 14 still functions as it is designed to. Indeed even if particulate matter is not being introduced into the converter, the high pressure air source 48 will keep the tuyere open and add auxiliary air to the blast.

Additionally, the tuyere injector 10 may be used without the blast air. In this instance, the tuyere injector 10 would act as permanently installed particulate feeder only. A particular downcomer 28 would be deactivated, sealed or dismantled with respect to a selected tuyere 14. Alternatively, an additional lined tuyere pipe 22 may be installed into the converter 60. The injector face plate 54 would be affixed directly to the attachment plate 26.

Continuing experimental tests indicate that the tuyere injector 10 meets all expectations. Problems involving powder compaction, blowback and inconsistent injection rates particularly of the finer powders, may possibly be traced to the initial experimental overall processing scheme shown in FIG. 2 and more particularly to the difficulties possibly caused by the demands placed upon the dust pump 70 owned by applicant. It appears that back pressure creates problems with finer material although courser material is introduced into the injector 10 at satisfactory rates. The simpler blow tank discussed previously may be suited for finer materials.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. An injector for introducing particulate matter into a tuyere extending through the wall of a vessel, the injector comprising a pipe adapted to be inserted into the tuyere, a housing circumscribing a portion of the pipe and forming an annular space therebetween, the annular space extending into the tuyere adjacent to the pipe, a blast air source directly communicating with the annular space, means for affixing the injector to a tuyere body affiliated with the tuyere, means for introducing a source of pressurized fluid directly to the annular space through the housing, and means for connecting the pipe to a source of the particulate matter.

2. The injector according to claim 1 wherein a housing spatially circumscribes the pipe, the annular space disposed therebetween, the housing adapted to be affixed to the tuyere, the housing including means for coupling the housing to the source of pressurized fluid.

3. In combination with a pyrometallurgical vessel, the vessel including a wall, and one or more tuyeres having an external tuyere body extending through the wall, at least one of the tuyeres adapted to introduce particulate matter into the vessel, the combination comprising a housing adapted to be connected to the tuyere body, a pipe partially disposed within the housing and extending thereout, the housing and the pipe forming an annular space therebetween, the annular space extending into the tuyere, a blast air source directly communicating with the annular space, a source of pressurized fluid communicating with the housing and the annular space, and means for introducing particulate matter into the pipe.

4. The combination according to claim 3 wherein the housing is a tee connector, having a diameter larger than the diameter of the pipe, and the annular space disposed between the tee connector and the pipe.

5. The combination according to claim 4 wherein the tee connector is attached to the tuyere body.

6. The combination according to claim 4 wherein an adaptor circumscribes the pipe to form the annular space and seals one end of the tee connector.

7. A method of operating a tuyere affixed to a vessel, the method comprising:

1) inserting a tuyere injector into the tuyere to form an annular space dispersed therebetween,
2) introducing particulate matter into the tuyere injector,
3) introducing pressurized fluid into the annular space to reduce accretion build-up within the tuyere, and
4) introducing blast air into the annular space.

* * * * *